US005628333A

United States Patent [19]

Sahm

[11] Patent Number: 5,628,333

[45] Date of Patent: May 13, 1997

[54] HAIR CURLER

[76] Inventor: Jürgen E. Sahm, Baumgarten 21, Arni CH-8905, Switzerland

[21] Appl. No.: 532,686

[22] PCT Filed: Feb. 9, 1995

[86] PCT No.: PCT/CH95/00031

§ 371 Date: Oct. 6, 1995

§ 102(e) Date: Oct. 6, 1995

[87] PCT Pub. No.: WO95/21553

PCT Pub. Date: Aug. 17, 1995

[30] Foreign Application Priority Data

Feb. 11, 1994 [CH] Switzerland ..... 00419/94

[51] Int. Cl.[6] ..... A45D 1/02; A45D 2/22

[52] U.S. Cl. ..... 132/227; 132/228; 132/223; 132/226; 132/272

[58] Field of Search ..... 132/227, 228, 132/223, 230, 226, 272

[56] References Cited

U.S. PATENT DOCUMENTS

| | | | |
|---|---|---|---|
| 3,199,218 | 8/1965 | Bean | 132/228 |
| 3,365,811 | 1/1968 | Djenner | 132/227 |
| 3,802,442 | 4/1974 | Serdar | 132/228 |
| 4,387,729 | 6/1983 | Abdalla | 132/227 |
| 5,316,025 | 5/1994 | Sahm | 132/227 |

FOREIGN PATENT DOCUMENTS

| | | | |
|---|---|---|---|
| 2747595 | 4/1979 | Germany | 132/227 |
| 634974 | 3/1983 | Switzerland | 132/227 |

*Primary Examiner*—Gene Mancene
*Assistant Examiner*—Pedro Philogene
*Attorney, Agent, or Firm*—The Firm of Gordon W. Hueschen

[57] ABSTRACT

The hair curler includes an outer and an inner sleeve. Both sleeves include passages in their walls. The sleeves can be rotated relative to each other. Accordingly, the passages in the outer sleeve can be opened or shut off. The hair curler includes a hollow flange portion with passages which cannot be closed off and an inlet opening for a feeding of warm air for a treatment of hair wound on the curler. When the passages of the outer sleeve are closed off, warm air will flow merely in an axial direction out of the passages of the flange portion. This state is needed for a slight drying of the hair when producing a permanent wave. When the passages of the outer sleeve are opened, the hair wound therearound are dried after the rinsing thereof by warm air flowing through the passages out of the inner space of the curler and by further warm airstream flowing out of the exit openings of the hollow flange portion. Therefore, only one set of hair curlers is needed for a treatment of hair and the hair must not be wound onto two different kinds of curlers.

4 Claims, 1 Drawing Sheet

HAIR CURLER

BACKGROUND OF THE INVENTION

1. FIELD OF THE INVENTION

The present invention relates to a hair curler having a hollow cylinder-shaped portion for the receipt of hair to be wound thereon, which cylinder-shaped portion has an inner space and ends at both ends at a respective flange portion, of which flange portions one flange portion is structured as a hollow body having a further inner space which communicates with the inner space of the cylinder-shaped portion, which cylinder-shaped portion has a circumferential wall structure and a longitudinal center axis, which one flange portion includes further an inlet opening which is adapted to be mounted to a hose for feeding hot air into the further inner space of the one flange portion and into the inner space of the cylinder-shaped portion, which one flange portion includes air exit openings directed towards the cylinder-shaped body and in a direction substantially parallel to its longitudinal axis and which cylinder-shaped portion includes in its circumferential wall structure radially thereto directed air exit openings.

2. DESCRIPTION OF THE PRIOR ART

In order to produce permanent waves the hair of a person is initially washed and wound onto hair curlers and thereafter treated in accordance with known methods with a permanent wave agent and thereafter with a neutralizing agent in order to obtain hair which are permanently waved.

Thereafter the hair or strands of hair, respectively, are wound off of the curlers and wound onto further curlers for a drying of the hair, whereby hot or warm, respectively, air is fed through such curler to the hair in order to dry same.

This repeated winding on and winding off of the hair is a tedious and time-consuming procedure and, furthermore, two sets of hair curlers structured quite differently are needed for such procedure.

SUMMARY OF THE INVENTION

A general objection of the invention is, therefore, to provide a hair curler, by means of which warm air can be fed from inside of the curler to the hair to be dried and which is suitable simultaneously as hair curler for supporting hair which are exposed to treatment liquids, whereby the inner space of the curler does not communicate with the ambient during such treatment.

A further object is to provide a hair curler having a cylinder-shaped portion which is structured as a rotary valve body which is rotatable between a valve open position and a valve closed position, which valve body in the open position allows a communication between the inner space of the cylinder-shaped portion and the environment and in the closed position blocks the communication between the inner space of the cylinder-shaped portion and the environment, whereby the air exit openings of the one flange portion remain open in both positions of the valve body.

Yet a further object is to provide a hair curler having a cylinder-shaped portion which comprises an outer sleeve having a plurality of air passage openings, whereby the valve body is designed as an inner sleeve supported for rotation in the outer sleeve and includes at least one air passage opening in its circumferential wall.

Yet a further object is to provide a hair curler, in which the inner sleeve is firmly connected to at least a part of the one flange portion structured as a hollow body for rotation therewith, whereby the inlet opening adapted to be connected to a hose is located at the one flange portion structured as a hollow body, and in which the outer sleeve is firmly connected at its end remote from the one flange portion structured as a hollow body to a disk-shaped flange portion for rotation therewith.

A further object is to provide a hair curler, in which the outer sleeve is firmly connected at the end remote from the disk-shaped flange portion to a disk for rotation therewith, which disk includes recesses along its circumference forming the air exit openings of the one flange portion structured as a hollow body, which disk forms a part of the one flange portion structured as a hollow body, such that the one flange portion structured as a hollow body includes a part firmly connected to the inner sleeve for rotation therewith and a further part firmly connected to the outer sleeve for rotation therewith, which two parts are rotatable relative to each other together with the outer and inner, respectively, sleeves.

Still a further object is to provide a hair curler, in which an inner sleeve includes a number of air passage openings in its circumferential wall which equals the number of air passage openings of the outer sleeve, which air passage openings of the inner sleeve are aligned with the air passage openings of the outer sleeve when the valve body of the cylinder-shaped portion structured as a rotary valve is in its valve open position.

BRIEF DESCRIPTION OF THE DRAWINGS

The present invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
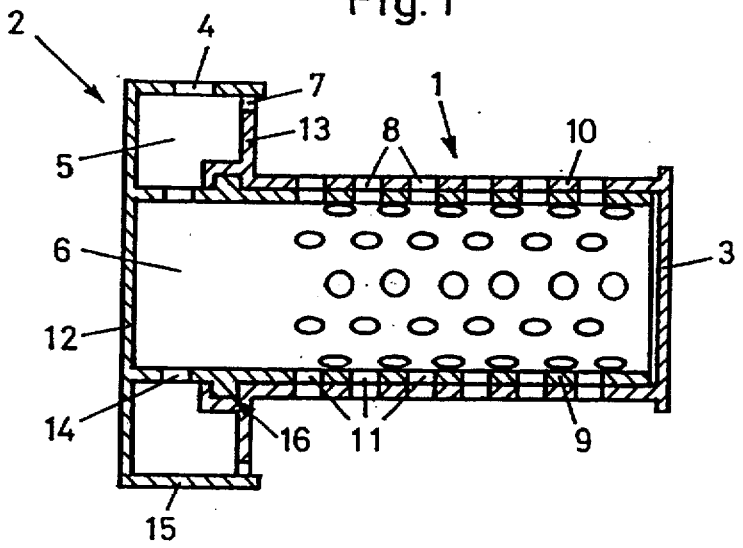
FIG. 1 is a longitudinal section through a hair curler.
Figure 2:
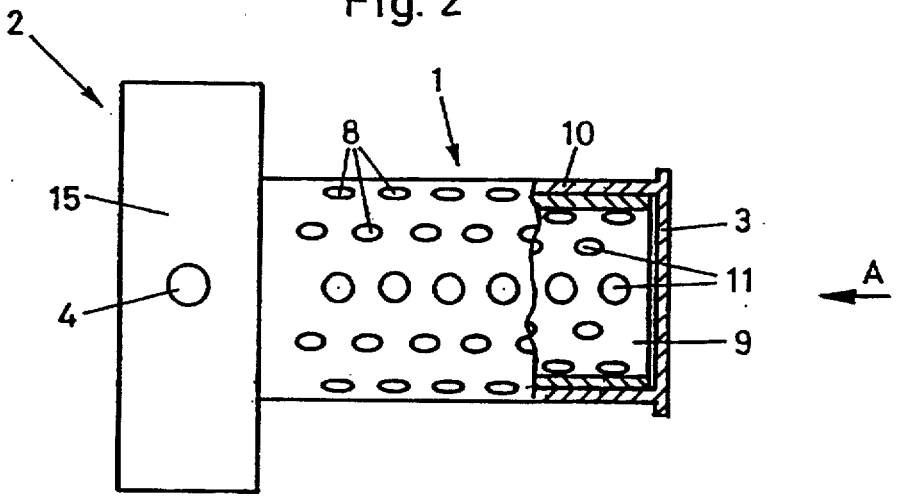
FIG. 2 is a side view of the hair curler illustrated in FIG. 1, partly in section.
Figure 3:
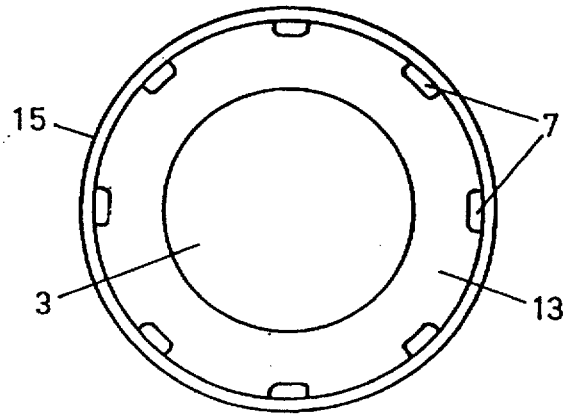
FIG. 3 is a view of the hair curler in the direction of the arrow A of FIG. 2.

The hair curler includes generally a cylinder-shaped portion 1 which is structured as hollow body having an inner space 6. The cylinder-shaped portion ends at one side at a flange portion 2, which is also structured as a hollow body having an inner space 5. The inner space 5 communicates via passages 14 with the inner space 6. At the opposite side the cylinder-shaped portion 1 ends at a flange portion structured as a disk Therefore, hair to be treated are wound onto the cylinder-shaped portion 1 between the flange portion 2 structured as a hollow body and the flange portion structured as a disk 3.

The cylinder-shaped section 1 is composed of an outer sleeve 10 and an inner sleeve 9. In its circumferential wall the outer sleeve 10 includes bores arranged in a pattern which act as air exit openings 8.

The inner sleeve 9 includes also in its circumferential wall bores arranged in a pattern, which bores act as air passage openings 11. In the illustrated example the pattern of the air passage openings 8 equals the pattern of the air passage openings 11. However, and specifically with regard to the inner sleeve 9 other designs for an air passage are foreseen, for instance, one single axially extending slot or a plurality of axially extending slots could be formed in the circumferential wall of the inner sleeve 9.

The inner sleeve 9 is firmly connected to a part 12 of the hollow flange portion 2 for rotation therewith. In the illustrated embodiment the sleeve 9 is structured integrally with this part 12. The inner space 5 of the hollow flange portion 2 communicates via at least one passage 14 with the inner space 6 in the inner sleeve 9. The part 12 of the hollow flange portion 2 includes, such as illustrated in FIG. 1, a radially extending, plate shaped end portion followed by an axially directed circumferential portion 15. An inlet opening 4 is formed in this circumferential portion 15. This inlet opening 4 is adapted to be connected to a hose, which communicates with a source of warm air. Apparatuses having a source of warm air, which is connected via hoses to hollow hair curlers, whereby the fed warm air flows into the inner space of the hair curler and from there through bores in the circumferential wall of the hair curler out, in order to dry hair wound onto the curler are generally known and accordingly must not be described further in detail.

The outer sleeve 10 with the air passage openings 11 ends at one end at a disk-shaped flange portion 3.

Although in FIG. 1 the outer sleeve 10 and the disk-shaped flange portion 3 are designed as integral structure, it is distinctly to be noted that they could be two separate structures which are firmly connected to each other for common rotation. It is also possible that e.g. the outer sleeve 10 is made of aluminium and the flange portion 3 is made of a plastic material. The same is true for the inner sleeve 9 and the hollow flange portion 2.

At the end of the outer sleeve 10 remote from the disk-shaped flange section 3 the outer sleeve 10 is connected to a disk 13 which again can be designed integrally with the outer sleeve 10 or could be a separate part mounted firmly for rotation with the sleeve 10, which part possibly can again consist of a different material.

This disk 13 forms a part of the hollow flange portion 2. Recesses are formed along the circumference of this disk 13, which recesses are covered along the circumference by the circumferential portion 15 such that air exit openings of the hollow flange portion 2 are formed, which are directed in the axial direction of the sleeves 9, 10.

The inner sleeve 9 is supported for rotation in the outer sleeve 10, whereby the reference numeral 16 identifies a merely schematically designed axial guide. Accordingly, the disk-shaped part 13 of the hollow flange portion 2 can be rotated relative to the other portion of the flange section 2, i.e. relative to the parts 12 and 15. In the illustrated position of the sleeves 9, 10 the air exit openings 8 of the outer sleeve 10 are aligned with the air passage openings 11 of the inner sleeve 9. Accordingly, in operation warm air flowing in through the inlet opening 4 can flow through the passage 14 into the inner space 6 of the inner sleeve 9 and flow out through the aligned openings 8, 11 in radial direction in order to dry hair wound onto the outer sleeve 10.

When the two sleeves 9, 10 are rotated relative to each other, the portions of the circumferential wall of the inner sleeve 9 having no bores block the air exit openings 8, such that no air will flow out of the inner space. As can be seen, a relative rotation by an angle of only a few degrees is necessary for an opening and closing, respectively, of the air exit openings 8. Obviously not specifically shown abutments, possibly locking members are present, which lock the two sleeves 9, 10 in the open and closed, respectively, position and limit the rotational movement, respectively.

It can be seen, furthermore, that independently of the air exit openings being opened or shut off, the air exit openings 7 of the hollow flange portion 2 remain permanently open, such that in operation continuously axially directed warm air flows for a drying of the outer circumferential area of the wound strands of hair exit these air exit openings 7.

The adjusting, i.e. the relative rotating of the sleeves 9, 10 can be made quite simply and conveniently. It is merely necessary to grip with the one hand the disk-shaped flange section 3 and by the other hand the hollow flange portion 2, specifically its circumferential portion 15, and to cause by a small movement of at least one hand the relative rotation between the two sleeves 9, 10.

For the treatment of the hair, strands of hair are wound onto respective hair curlers. The sleeves 9, 10 of each hair curler are initially rotated in such a position (which can be done prior to or after the winding of the hair thereupon), in which the air exit openings 8 are blocked. Thereafter, the treatment of the hair for the forming of permanent waves is made in accordance with generally known procedures. The initial slight warming of the hair is made only by the warm air exiting axially out of the air exit openings 7 of the hollow flange portion 2. After the hair have been rinsed, the sleeves 9, 10 are rotated relative to each other such that the air passage openings 8 of the outer sleeve 10 are opened such that now the hair can be dried uniformly by warm air exiting from the inside through the openings 8 and warm air coming from the outside through the openings 7.

Accordingly, an entire treatment of hair can be done with merely one kind of hair curlers, such that a considerable savings on the time for treating the hair is arrived at.

While there is shown and described a present preferred embodiment of the invention, it is to be distinctly understood that the invention is not limited thereto, but may be otherwise variously embodied and practiced within the scope of the following claims.

I claim:

1. A hair curler having a hollow cylinder-shaped portion for the receipt of hair to be wound thereon, which cylinder-shaped portion has an inner space and ends at both ends at a respective flange portion, of which flange portions one flange portion is structured as a hollow body having a further inner space which communicates with the inner space of the cylinder-shaped portion, which cylinder-shaped portion has a circumferential wall structure and a longitudinal center axis, which one flange portion includes further an air inlet opening which is adapted to be mounted to a hose for feeding hot air into said further inner space of said one flange portion and into said inner space of said cylinder-shaped portion, which one flange portion includes air exit openings directed towards said cylinder-shaped portion and in a direction substantially parallel to its longitudinal axis and which cylinder-shaped portion includes in its circumferential wall structure radially thereto directed air exit openings, in which said cylinder-shaped portion is structured as a rotary valve with a valve body which is rotatable between a valve open position and a valve closed position, which valve body in the open position allows a communication between the inner space of the cylinder-shaped portion and the environment and in the closed position blocks the communication between the inner space of the cylinder-shaped portion and the environment, whereby the air exit openings of said one flange portion remain open in both positions of said valve body, in which said cylinder-shaped portion comprises an outer sleeve having a plurality of air passage openings and said valve body is designed as an inner sleeve supported for rotation in said outer sleeve and includes at least one air passage opening in its circumferential wall.

2. The hair curler of claim 1, in which said inner sleeve is firmly connected to at least a part of said one flange portion structured as a hollow body for rotation therewith, whereby said inlet opening adapted to be connected to a hose is located at said one flange portion structured as a hollow body, and in which said outer sleeve is firmly connected at its end remote from said one flange portion structured as a hollow body to a disk-shaped flange portion for rotation therewith.

3. The hair curler of claim 2, in which said outer sleeve is firmly connected at the end remote from said disk-shaped flange portion to a disk for rotation therewith, which disk includes recesses along its circumference forming the air exit openings of said one flange portion structured as a hollow body, which disk forms a part of said one flange portion structured as a hollow body, such that said one flange portion structured as a hollow body includes a part firmly connected to said inner sleeve for rotation therewith and a further part firmly connected to said outer sleeve for rotation therewith, which two parts are rotatable relative to each other together with the outer and inner, respectively, sleeves.

4. The hair curler of claim 1, in which said inner sleeve includes a number of air passage openings in its circumferential wall which equals the number of air passage openings of the outer sleeve, which air passage openings of the inner sleeve are aligned with the air passage openings of the outer sleeve when said valve body of said cylinder-shaped portion structured as a rotary valve is in its valve open position.

* * * * *

UNITED STATES PATENT AND TRADEMARK OFFICE

CERTIFICATE OF CORRECTION

PATENT NO. : 5,628,333
DATED : May 13, 1997
INVENTOR(S) : Jurgen E. Sahm

It is certified that error appears in the above-indentified patent and that said Letters Patent is hereby corrected as shown below:

Column 2, line 49: "as a disk" should read
-- as a disk 3. --.

Signed and Sealed this

Fifteenth Day of July, 1997

Bruce Lehman

*Attest:*

BRUCE LEHMAN

*Attesting Officer*

*Commissioner of Patents and Trademarks*